US010209671B2

(12) United States Patent
Nishikawa

(10) Patent No.: US 10,209,671 B2
(45) Date of Patent: Feb. 19, 2019

(54) IMAGE FORMING APPARATUS WITH COOLING FAN CONTROL

(71) Applicant: CANON KABUSHIKI KAISHA, Tokyo (JP)

(72) Inventor: Kosuke Nishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/233,005

(22) Filed: Aug. 10, 2016

(65) Prior Publication Data

US 2017/0060084 A1 Mar. 2, 2017

(30) Foreign Application Priority Data

Aug. 28, 2015 (JP) ..... 2015-169067

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS 5,787,321 A * 7/1998 Nishikawa ..... G03G 15/2042 165/205
8,224,197 B2 7/2012 Mohri et al.
2003/0219274 A1* 11/2003 Hirose ..... G03G 21/206 399/92
2004/0000886 A1* 1/2004 Yun ..... G03G 15/205 318/268
2004/0240904 A1* 12/2004 Koontz ..... G03G 15/5066 399/75
2006/0051124 A1* 3/2006 Oka ..... G03G 21/206 399/94
2011/0052246 A1* 3/2011 Kyung ..... G03G 21/206 399/92

FOREIGN PATENT DOCUMENTS

| | | | |
|---|---|---|---|
| JP | 61-219966 | * | 9/1986 |
| JP | 02-214871 | A | 8/1990 |
| JP | 2002-215005 | A | 7/2002 |
| JP | 2004-109537 | A | 4/2004 |
| JP | 2006-227559 | A | 8/2006 |
| JP | 2008-242488 | A | 10/2008 |
| JP | 2010-244032 | A | 10/2010 |

* cited by examiner

*Primary Examiner* — G. M. A Hyder
(74) *Attorney, Agent, or Firm* — Venable LLP

(57) ABSTRACT

First intake and first exhaust fans provided in a first image forming apparatus and second intake and second exhaust fans provided in a second image forming apparatus having a slower normal image forming speed than the first image forming apparatus are configured with the same specifications, and the numbers of revolutions of the second intake and second exhaust fans are driven and controlled to become less than the numbers of revolutions of the first intake and first exhaust fans.

22 Claims, 6 Drawing Sheets

IMAGE FORMING APPARATUS WITH COOLING FAN CONTROL

BACKGROUND OF THE INVENTION

Field of the Invention

The present invention relates to an image forming apparatus such as a copying machine, a printer, or a facsimile machine.

Description of the Related Art

Conventionally, image forming apparatuses such as copying machines, printers, and facsimile machines perform control to decrease wind noise of a cooling fan by operating the cooling fan only when it is needed with the view to decrease operation noise. For example, Japanese Patent Laid-Open No. 2008-242488 decreases the wind noise of a plurality of cooling fans by controlling ON/OFF and the numbers of revolutions of the cooling fans according to the temperature of a fixing device.

Further, Japanese Patent Laid-Open No. 02-214871 suppresses generation of noise by switching operations or the numbers of revolutions of the cooling fans according to the number of copied sheets.

In recent years, models of a wide-range of image forming apparatuses that realize a plurality of productivities while increasing development efficiency by sharing a mechanical configuration and the like have become the mainstream. In such models of image forming apparatuses, a model of an image forming apparatus with a lower productivity is less easily increased in the temperature in the apparatus than a model of an image forming apparatus with a higher productivity, and thus requires less cooling by the cooling fans. However, conventionally, the cooling by the cooling fans necessary for the model of the image forming apparatus with a higher productivity has also been performed in the model of the image forming apparatus with a lower productivity, and thus the wind noise of the cooling fans has been noticeable.

In the models of the wide-range image forming apparatuses with a plurality of productivities and sharing the mechanical configuration, the model of the image forming apparatus with a lower productivity has smaller operation noise of drive systems because motor speeds of the drive systems are slower than those of the model of the image forming apparatus with a higher productivity. Meanwhile, as for the cooling fans, the model of the image forming apparatus with a lower productivity and the model of the image forming apparatus with a higher productivity have equivalent numbers of revolutions. Therefore, there is a problem that the entire operation noise of the mode of the image forming apparatus with a lower productivity is not substantially different from that of the model of the image forming apparatus with a higher productivity.

SUMMARY OF THE INVENTION

It is desirable to provide an image forming apparatus that achieves both of suppression of an increase in the temperature in the apparatus and a decrease in operation noise in a model, in image forming apparatuses having the same mechanical configuration.

It is also desirable to provide an image forming apparatus having a same structure as a first image forming apparatus having a first number of images as a maximum number of outputs per unit time, the image forming apparatus having a second number of images as the maximum number of outputs per unit time, the second number of images being smaller than the first number of images, the image forming apparatus including: an image forming portion which forms an image on a recording material; a fan which cools the image forming portion, the fan having a same specification as a fan attached to a predetermined position of the first image forming apparatus, and attached to a same position as the position at which the fan is attached to the first image forming apparatus; and a controller which controls and drives the fan at a second number of revolutions smaller than a first number of revolutions that is a number of revolutions per unit time, when executing a mode corresponding to a first mode to cool the first image forming apparatus by driving the fan at the first number of revolutions, and controls and drives the fan at a same number of revolutions as a number of revolutions set to the first image forming apparatus, when executing a mode corresponding to a second mode to cool the first image forming apparatus by driving the fan in the first image forming apparatus.

Further features of the present invention will become apparent from the following description of exemplary embodiments (with reference to the attached drawings).

DESCRIPTION OF THE EMBODIMENTS

An embodiment of an image forming apparatus according to the present invention will be specifically described with reference to the drawings.

First Embodiment

First, a configuration of a first embodiment of an image forming apparatus according to the present invention will be described using FIGS. 1 to 5.

<Image Forming Apparatus>

Figure 1:
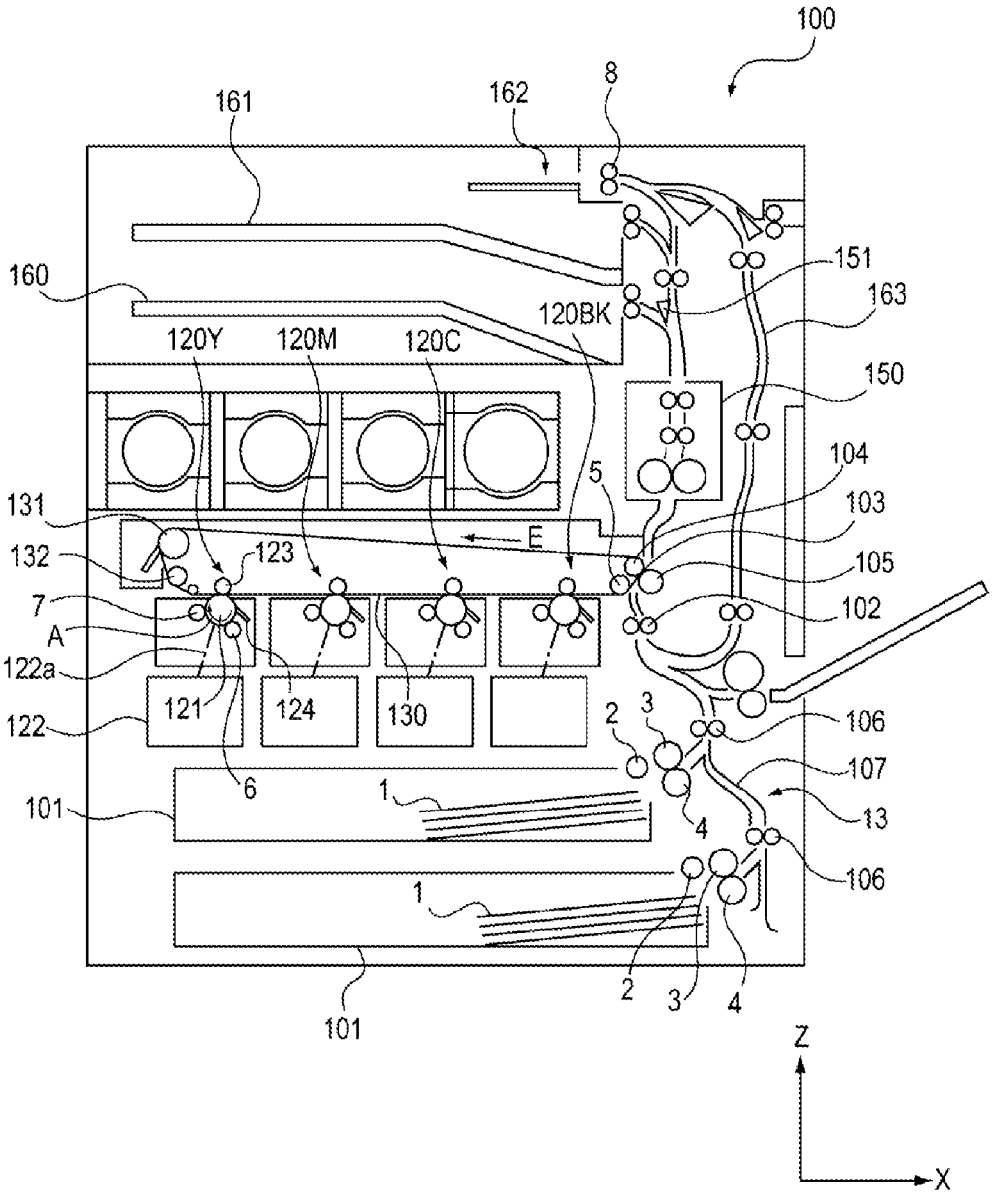
FIG. 1 is an explanatory sectional view illustrating a configuration of an image forming apparatus according to the present invention.

First, a configuration of an image forming apparatus according to the present invention will be described using FIG. 1. FIG. 1 is an explanatory sectional view illustrating a configuration of an image forming apparatus 100 of the present embodiment. In FIG. 1, image forming portions 120Y, 120M, 120C, and 120Bk of respective colors including yellow Y, magenta M, cyan C, and black Bk are as follows. For convenience of description, description may be given simply using an image forming portion 120 as a typical image forming portion of the image forming portions

120Y, 120M, 120C, and 120Bk of the respective colors. The same applies to other image forming process portions.

<Image Forming Portion>

Each of the image forming portions 120 includes a photosensitive drum. 121 serving as an image bearing member that is rotated in the arrow A direction of FIG. 1, and a charging roller 6 serving as a charging portion that uniformly changes a surface of the photosensitive drum 121. Further, the image forming portion 120 includes a laser scanner 122 serving as an image exposing portion that irradiates the surface of the photosensitive drum 121 uniformly charged by the charging roller 6 with laser light 122*a* according to image information, and forms an electrostatic latent image.

Further, the image forming portion 120 includes a developing roller 7 serving as a developer bearing member provided in a developing device (not illustrated) serving as a developing portion that supplies a toner serving as a developer to the electrostatic latent image formed on the surface of the photosensitive drum. 121 by the laser scanner 122 and develops the electrostatic latent image as a toner image.

Further, the image forming portion 120 includes a primary transfer roller 123 serving as a primary transfer portion that is provided at an inner peripheral surface side of an intermediate transfer belt 130 and primarily transfers the toner image formed on the surface of the photosensitive drum 121 to an outer peripheral surface of the intermediate transfer belt 130. Further, the image forming portion 120 includes a cleaning blade 124 serving as a cleaning portion that scrapes off and collects the toner remaining on the surface of the photosensitive drum 121 after the primary transfer.

The intermediate transfer belt 130 is stretched around a drive roller 131, a tension roller 132, a secondary transfer inner roller 104, and a driven roller 5 in the arrow E direction of FIG. 1. As the image forming portions 120 of the present embodiment, the image forming portions 120 of the respective colors including yellow Y, magenta M, cyan C, and black Bk are provided in order from the left side of FIG. 1, and are approximately similarly configured except for the colors of toners.

The surface of the photosensitive drum 121 rotated in the arrow A direction of FIG. 1 is uniformly charged by the charging roller 6. Following that, the surface of the photosensitive drum 121 uniformly charged by the charging roller 6 is irradiated with the laser light 122*a* emitted from the laser scanner 122 according to image information, so that the electrostatic latent image is formed.

Then, the toner of each of the respective colors is supplied by the developing roller 7 provided in the developing device to the electrostatic latent image formed on the surface of the photosensitive drum 121 and is developed as a toner image. Following that, predetermined pressurizing force is applied to the surface of the photosensitive drum 121 by the primary transfer roller 123 through the intermediate transfer belt 130. At the same time, a primary transfer bias voltage is applied to the primary transfer roller 123, and the toner images of the respective colors formed on the surfaces of the photosensitive drums 121 are sequentially superimposed on the outer peripheral surface of the intermediate transfer belt 130 and are primarily transferred.

A transfer residual toner slightly remaining on the surface of the photosensitive drum 121 after the primary transfer is scraped off by the cleaning blade 124 and is collected in a cleaner container. Accordingly, the photosensitive drums 121 of the respective colors are again provided for the next image formation.

Image forming processes of the respective colors processed in parallel by the image forming portions 120 of the respective colors are performed at timing to superimpose the toner images of the respective colors sequentially primarily transferred on the outer peripheral surface of the intermediate transfer belt 130 from an upstream side in a rotating direction of the intermediate transfer belt 130 illustrated by the arrow E direction of FIG. 1. As a result, a full color toner image is finally formed on the outer peripheral surface of the intermediate transfer belt 130, and is conveyed to a secondary transfer nip portion 103 formed by the outer peripheral surface of the intermediate transfer belt 130 stretched over an outer periphery of the secondary transfer inner roller 104 and a secondary transfer outer roller 105.

As the image forming portions 120 of the present embodiment, an example in which the four colors including yellow Y, magenta M, cyan C, and black Bk are provided in order from the left side of FIG. 1 is illustrated. As other examples, an image forming portion 120 of a single color or image forming portions 120 of a plurality of colors other than the four colors may be provided. Further, the order of arranging the colors may be an order other than the present embodiment illustrated in FIG. 1.

<Recording Material Conveying Portion>

Meanwhile, recording materials 1 stored in a sheet cassette 101 are conveyed by a recording material conveying portion 13. The recording materials 1 stored in the sheet cassette 101 are sent out by a feed roller 2, and are separated and fed sheet by sheet by a feed roller 3 and a retard roller 4 in cooperation. Following that, the recording material 1 is conveyed by conveying rollers 106 and a conveying guide 107, a tip portion of the recording material 1 abuts against a nip portion of the registration roller 102 that has been stopped once, and the recording material 1 is stripped off due to resilience of the recording material 1 and skew feeding is corrected.

Following that, the recording material 1 is nipped and conveyed by the registration roller 102 at predetermined timing, and is conveyed to the secondary transfer nip portion 103 formed by the outer peripheral surface of the intermediate transfer belt 130 and the secondary transfer outer roller 105.

The secondary transfer nip portion 103 is formed of the secondary transfer inner roller 104 and the secondary transfer outer roller 105 facing the secondary transfer inner roller 104, having the intermediate transfer belt 130 lie therebetween. The secondary transfer outer roller 105 provides predetermined pressurizing force to the secondary transfer inner roller 104 through the intermediate transfer belt 130. At the same time, a secondary transfer bias voltage is applied to the secondary transfer outer roller 105. Accordingly, an unfixed toner image primarily transferred to the outer peripheral surface of the intermediate transfer belt 130 is electrostatically stuck on a surface of a recording material 1 conveyed by the secondary transfer nip portion 103.

Note that a conveying path on which the recording material 1 is conveyed is configured from the conveying rollers 106 arranged at the conveying guide 107 at appropriate intervals, the conveying guide 107 guiding the recording material 1 while keeping the behavior thereof to pass the recording material 1 while holding it.

The image forming process of the toner image formed on the outer peripheral surface of the intermediate transfer belt 130 sent to the secondary transfer nip portion 103 at similar timing to the conveying process of conveying the recording material 1 to the secondary transfer nip portion 103 will be described.

The full color toner image is secondarily transferred on the recording material 1 in the secondary transfer nip portion 103 by synchronizing the conveying process of the recording material 1 and the image forming process. Following that, the recording material 1 on which the full color toner image has been secondarily transferred is conveyed to a fixing device 150 serving as a fixing portion. Then, the recording material 1 is heated and pressurized while being nipped and conveyed by a fixing roller and a pressure roller provided in the fixing device 150, and the toner image is heated and melted and is heat-fixed to the recording material 1.

The recording material 1 on which the toner image has been heat-fixed is discharged onto a discharge tray 160 or 161 according to a turn position of a flapper 151. Alternatively, the recording material 1 is once conveyed to a reverse conveying portion 162 to perform image formation on both surfaces of the recording material 1, then a reverse roller 8 is reversely rotated, and a conveying path on which the recording material 1 is conveyed to a duplex conveying path 163 is selected.

Front and back surfaces are reversed in a process where the recording material 1 conveyed to the duplex conveying path 163 passes through the duplex conveying path 163, and the recording material 1 is nipped and conveyed by the registration roller 102 again and the toner image is similarly formed on the second surface.

<Cooling Fans>

Next, configurations of an intake fan 200 and an exhaust fan 201 serving as cooling fans that cool the image forming portion 120 will be described using FIGS. 2 and 3. Further, configurations of an intake duct 204 and an exhaust duct 205 serving as ventilation ducts will be described. Further, a configuration of a temperature sensor 203 that is a plurality of temperature detecting portions and serves as a first temperature detecting portion that detects an inside temperature Ti of a main body of the image forming apparatus 100 (a main body of an image forming apparatus) will be described. Further, a configuration of a temperature sensor 202 serving as a second temperature detecting portion that detects an outside temperature To of the main body of the image forming apparatus 100 will be described.

Figure 2:
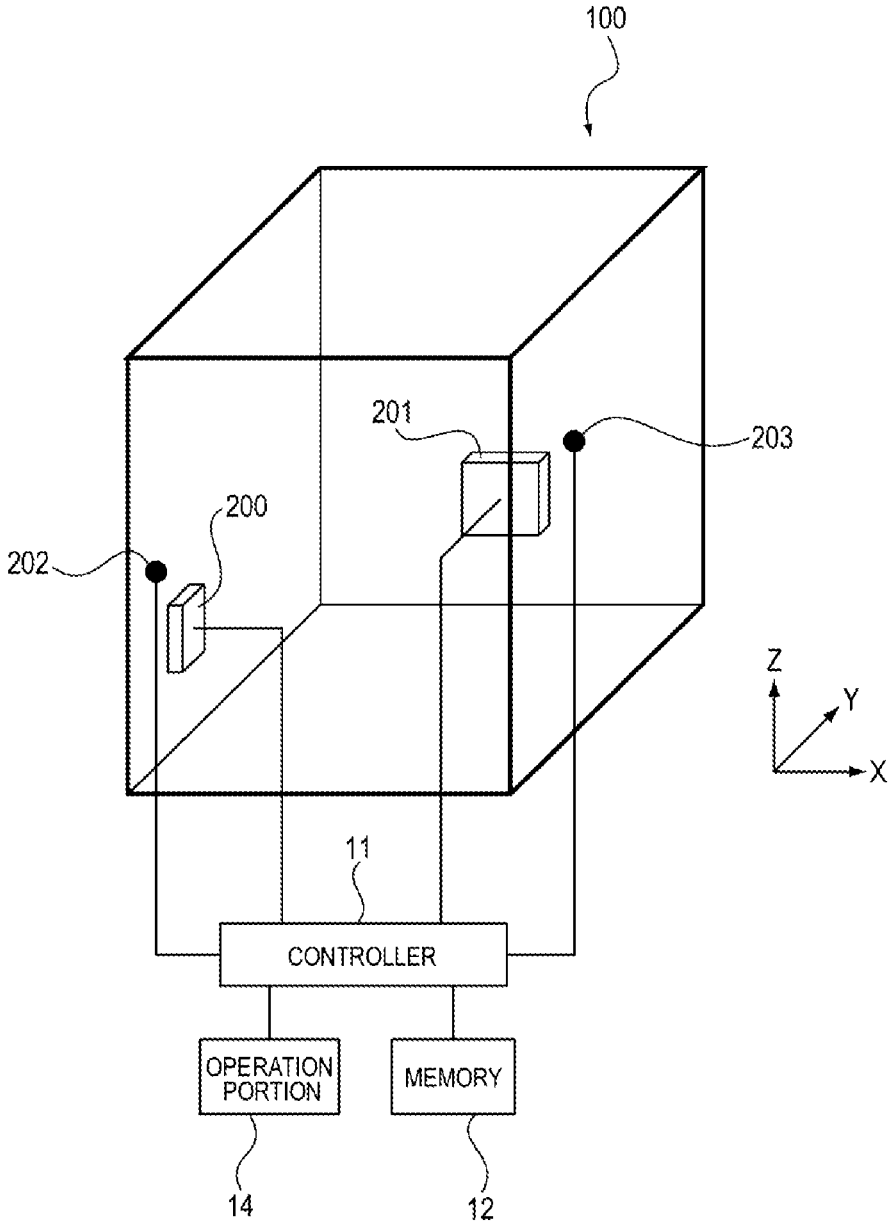
FIG. 2 is an explanatory sectional view illustrating a configuration of a control system of cooling fans that cool an image forming portion of the image forming apparatus according to the present invention.

FIG. 2 is an explanatory perspective view illustrating arranging positions of the intake fan 200, the exhaust fan 201, and the temperature sensors 202 and 203 provided in the image forming apparatus 100. FIG. 3 is an explanatory plan view illustrating arranging positions of the intake fan 200, the exhaust fan 201, the temperature sensors 202 and 203, the intake duct 204, and the exhaust duct 205 provided in the image forming apparatus 100.

Figure 3:
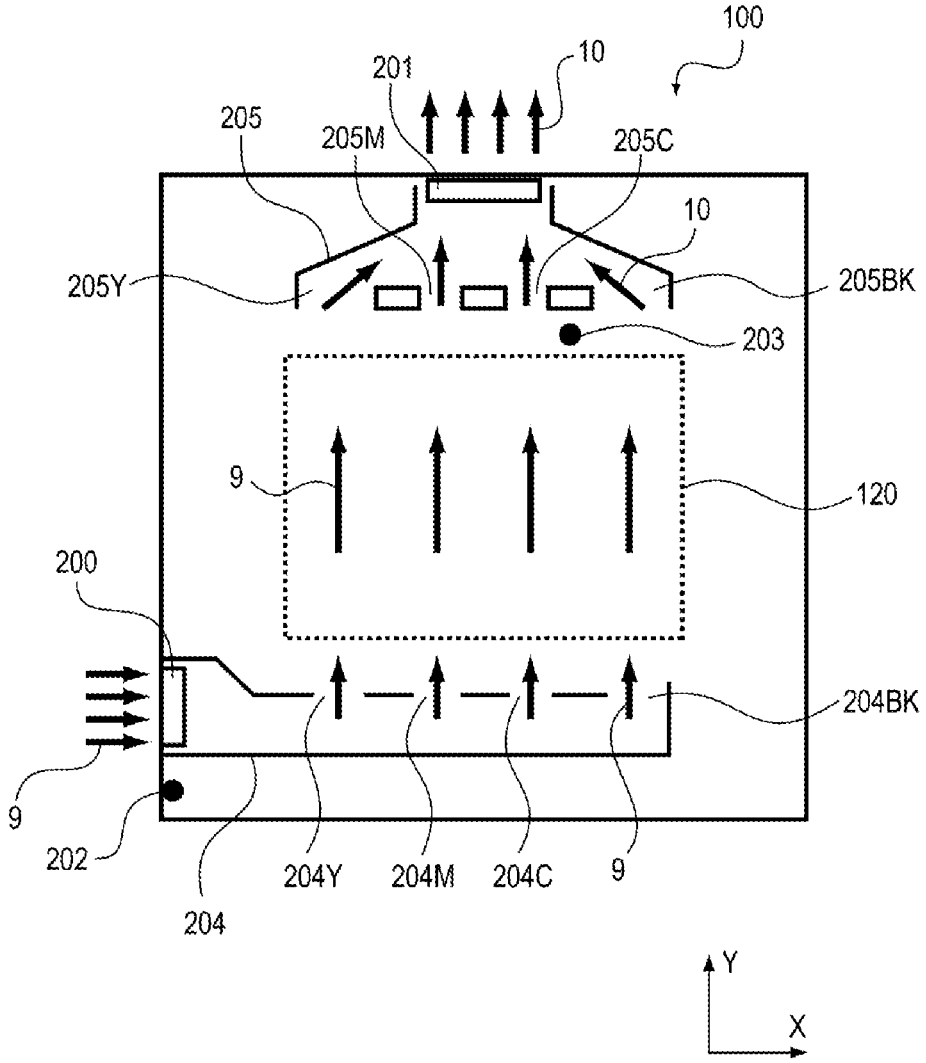
FIG. 3 is an explanatory plan view for describing an air flow by the cooling fans that cool the image forming portion of the image forming apparatus according to the present invention.

As illustrated in FIGS. 2 and 3, the intake fan 200 that sends outside air 9 into the main body of the image forming apparatus 100 is provided on a left-side surface of the image forming apparatus 100. Further, the temperature sensor 202 that detects the outside temperature To of the image forming apparatus 100 is provided near the intake fan 200.

The exhaust fan 201 that discharges the air in the main body of the image forming apparatus 100 to an outside is provided on a back surface of the image forming apparatus 100 (an upper portion in FIG. 3). Further, the temperature sensor 203 that detects the inside temperature Ti of the main body of the image forming apparatus 100 is provided close to the back surface in the main body of the image forming apparatus 100.

<Cooling Flow>

Next, a flow of the air in the main body of the image forming apparatus 100 will be described with the intake fan 200 and the exhaust fan 201 using FIG. 3. As illustrated in FIG. 3, the outside air 9 is taken in by drive of the intake fan 200 provided on the left-side surface of the image forming apparatus 100, and is sent to the intake duct 204 provided in the main body of the image forming apparatus 100.

The intake duct 204 is provided with four exhaust ports 204Y, 204M, 204C, and 204Bk respectively facing the image forming portions 120Y, 120M, 120C, and 120Bk of the respective colors illustrated in FIG. 1. The outside air 9 taken in by the drive of the intake fan 200 is as follows.

Air quantities respectively necessary for the image forming portions 120Y, 120M, 120C, and 120Bk of the respective colors are sent through the exhaust ports 204Y, 204M, 204C, and 204Bk provided in the intake duct 204. Accordingly, the outside air 9 cools the image forming portions 120Y, 120M, 120C, and 120Bk.

Further, the outside air 9 sent through the exhaust ports 204Y, 204M, 204C, and 204Bk of the intake duct 204 to the image forming portions 120Y, 120M, 120C, and 120Bk of the respective colors is as follows. The outside air 9 cools the image forming portions 120Y, 120M, 120C, and 120Bk.

Following that, the outside air 9 takes heat from the image forming portions 120Y, 120M, 120C, and 120Bk to become warm air 10. The warm air 10 is taken by drive of the exhaust fan 201 through the exhaust duct 205 and is discharged to an outside of the image forming apparatus 100. In the exhaust duct 205, intake ports 205Y, 205M, 205C, and 205Bk are provided in positions facing the exhaust ports 204Y, 204M, 204C, and 204Bk provided in the intake duct 204.

Comparative Example

Next, a control operation of an intake fan 200 and an exhaust fan 201 in an image forming apparatus 100 of a comparative example will be described using FIGS. 3 and 4. In step S100 of FIG. 4, a print job of the image forming apparatus 100 is started. Then, in step S101, an inside temperature Ti is detected by a temperature sensor 203 that detects the inside temperature Ti of the main body of the image forming apparatus 100. Further, an outside temperature To is detected by a temperature sensor 202 that detects the outside temperature To of the image forming apparatus 100.

Next, in step S102, when the inside temperature Ti is 24° C. or less, the control operation proceeds to step S109, and the intake fan 200 and the exhaust fan 201 are stopped. In step S102, when the inside temperature Ti is higher than 24° C., the control operation proceeds to step S103. When the inside temperature Ti is high temperature such as 31° C. or more, the control operation proceeds to step S107, and the intake fan 200 and the exhaust fan 201 are driven at the maximum rotating speed. Following that, in step S110, when the print job is terminated, the control operation proceeds to step S111 and the print job is terminated. In step S110, when the print job is continued, the operation returns to step S101.

In step S103, when the inside temperature Ti is lower than 31° C., the control operation proceeds to step S104. When the inside temperature Ti is from 26° C. to 29° C., both inclusive, the control operation proceeds to step S105, and operations of the intake fan 200 and the exhaust fan 201 are changed in consideration of a correlation between the inside temperature Ti and the outside temperature To.

In step S104, when the inside temperature Ti is from 24° C. to 26° C., both exclusive, or when the inside temperature Ti is from 29° C. to 31° C., both exclusive, the control operation proceeds to step S108, and immediately previous operations of the intake fan 200 and the exhaust fan 201 are maintained.

In step S104, when the inside temperature Ti is from 26° C. to 29° C., both inclusive, and in step S105, when the outside temperature To is higher than the inside temperature Ti, the operation is as follows. It is not necessary to take the hot outside air 9 into the main body of the image forming apparatus 100, and thus the control operation proceeds to step S109, and the intake fan 200 and the exhaust fan 201 are stopped.

Meanwhile, in step S105, when the inside temperature Ti is the outside temperature To or more, and in step S106, when the inside temperature Ti is higher than the outside temperature To by 2° C. or more, the operation is as follows. The operation proceeds to step S107, and the intake fan 200 and the exhaust fan 201 are driven at the maximum rotating speed.

Further, when a temperature difference ΔT (=Ti−To) between the inside temperature Ti and the outside temperature To is from 0° C. to 2° C., exclusive of 2° C., the control operation proceeds to step S108, and the immediately previous operations of the intake fan 200 and the exhaust fan 201 are maintained.

Figure 4:
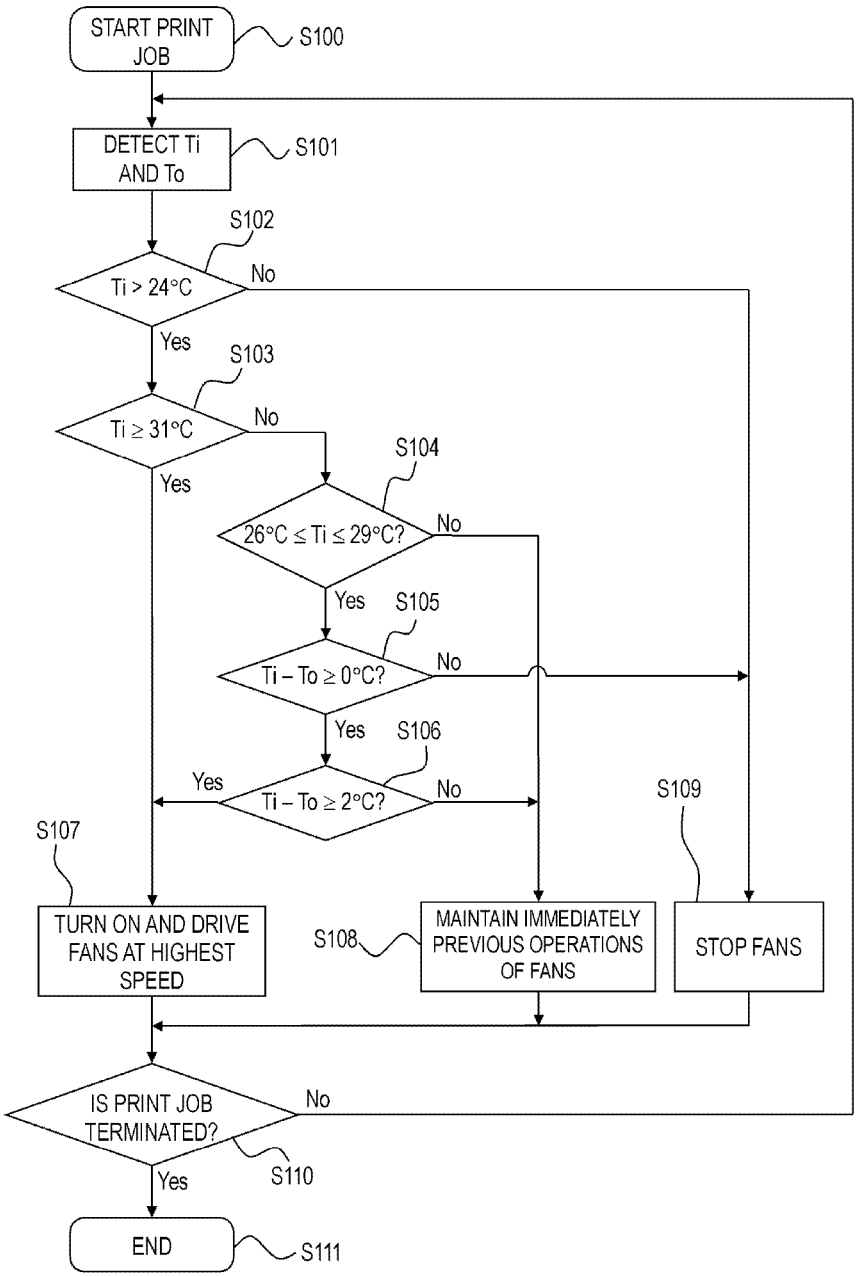
FIG. 4 is a flowchart illustrating drive control of cooling fans of a comparative example.

In the comparative example illustrated in FIG. 4, the inside temperature Ti is detected by the temperature sensor 203 and the outside temperature To is detected by the temperature sensor 202 on a steady basis during a print operation of the image forming apparatus 100. Then, the operations of the intake fan 200 and the exhaust fan 201 are switched in consideration of the correlation between the inside temperature Ti and the outside temperature To.

Initial states of the intake fan 200 and the exhaust fan 201 of the comparative example illustrated in FIGS. 3 and 4 are a stop state. Then, the operations of the intake fan 200 and the exhaust fan 201 are determined according to the flowchart illustrated in FIG. 4, in an adjusting operation when a power supply of the image forming apparatus 100 is turned ON.

In the present embodiment, four types of models of the image forming apparatuses 100 with different productivities are prepared. These models are models of a wide-range of image forming apparatuses that share a mechanical configuration including a frame body, and have a plurality of productivities. The models are as follows. The models are models of the image forming apparatuses 100 that can form an image on each of 60 recording materials 1 per minute (60 pages per minute (ppm)) by cross feed, the recording material 1 being an A4-size plain paper (the basis weight is up to 105 g/m2). Further, the models are models of the image forming apparatuses 100 that can form an image on 50 recording materials 1 (50 ppm), 40 recording materials 1 (40 ppm), and 35 recording materials 1 (35 ppm).

In the models of the image forming apparatuses 100, consider first cooling fans (the intake fan 200 and the exhaust fan 201) provided in a first image forming apparatus 100. Further, second cooling fans (the intake fan 200 and the exhaust fan 201) provided in a second image forming apparatus 100 having a slower image forming speed than the normal image forming speed of the first image forming apparatus 100. The first and second cooling fans (the intake fans 200 and the exhaust fans 201) are configured in the same specifications.

The models of the image forming apparatuses 100 with different productivities have the same specification of the rated air quantity and the shape, and are provided with the intake fan 200, the exhaust fan 201, the intake duct 204, and the exhaust duct 205 that are common, as illustrated in FIGS. 2 and 3.

In the present embodiment, the models of the image forming apparatuses 100 with different productivities (the first and second image forming apparatuses 100) are configured from image forming portions 120 and recording material conveying portions 13 illustrated in FIG. 1 and operation portions 14 illustrated in FIG. 2, which have the same specifications.

In the wide-range image forming apparatuses 100 that can support the range from the low speed to the high speed, the model of the image forming apparatus 100 with a low productivity (second image forming apparatus) is as follows. Rotating speeds of motors of drive systems are slower than those of the model of the image forming apparatus 100 with a high productivity (first image forming apparatus).

Therefore, the temperature in the main body of the image forming apparatus 100 is less likely to rise, and the air quantities of the intake fan 200 and the exhaust fan 201 can be small. However, in the control of the intake fan 200 and the exhaust fan 201 of the comparative example illustrated in FIG. 4, the intake fan 200 and the exhaust fan 201 are driven at the maximum rotating speed (full speed), regardless of the productivity of the image forming apparatus 100 (step S107).

Therefore, in the model of the image forming apparatus 100 with a low speed (35 ppm) (second image forming apparatus) where noise of the motors of the drive system and the like are relatively small, there is a problem that wind noise of the intake fan 200 and the exhaust fan 201 are relatively noticeable. Especially, as illustrated in FIGS. 2 and 3, the intake fan 200 and the exhaust fan 201 are provided near the left-side surface and the back surface of the image forming apparatus 100, and thus the numbers of revolutions of the intake fan 200 and the exhaust fan 201 substantially influence on the operation noise of the image forming apparatus 100.

Next, control operations of the intake fan 200 and the exhaust fan 201 in the image forming apparatus 100 in the present embodiment will be described using FIGS. 3 and 5. A difference in control of the present embodiment from that of the intake fan 200 and the exhaust fan 201 of the comparative example illustrated in FIG. 4 is as follows. A plurality of duty ratios F (%) of a pulse width of a pulse voltage that drives the intake fan 200 and the exhaust fan 201 is set according to the inside temperature Ti of the image forming apparatus 100.

Then, the duty ratios F of the pulse width of the pulse voltage that drives the intake fan 200 and the exhaust fan 201 are changed according to the models of the image forming apparatuses 100 with different productivities. Note that the duty ratio F refers to a ratio (%) of a pulse width of when a total width of the pulse width of the pulse voltage that drives the intake fan 200 and the exhaust fan 201 is 100%.

Figure 5:
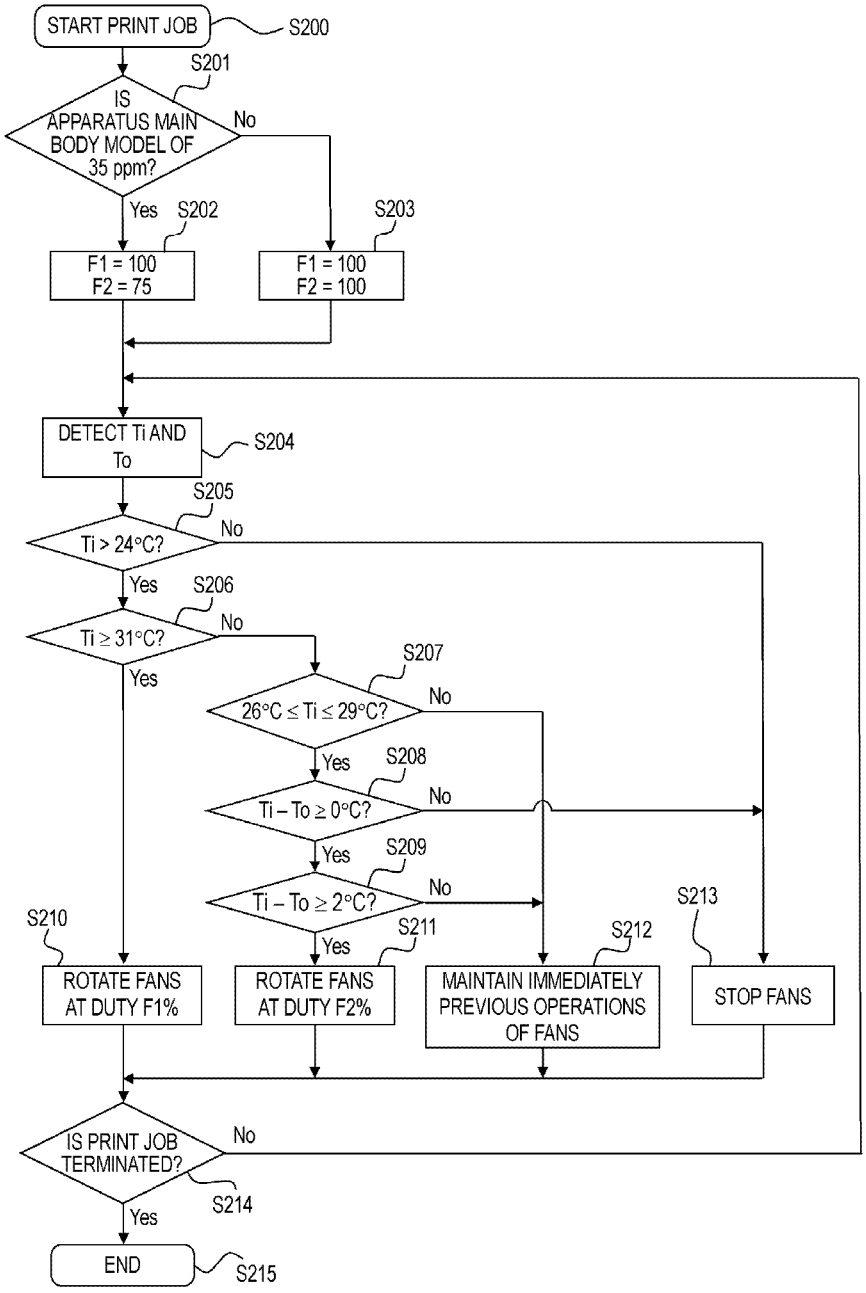
FIG. 5 is a flowchart illustrating drive control of cooling fans of a first embodiment of an image forming apparatus according to the present invention.

In step S200 of FIG. 5, when a print job of the image forming apparatus 100 is started, a controller 11 first confirms the models of the image forming apparatuses 100 with different productivities in step S201.

For example, information about which model the image forming apparatus 100 corresponds to, among the image forming apparatuses 100 of a plurality of derivative models with different process speeds, is stored and registered in a memory (storage medium) provided in the image forming apparatus 100 in advance. The controller 11 can confirm the models of the image forming apparatuses 100 with different productivities, from the model information stored in the memory.

The duty ratios F1 and F2 set in advance as the duty ratios F of the pulse width of the pulse voltage that drives the intake fan 200 and the exhaust fan 201 are input according to the models of the image forming apparatuses 100 (steps S202 and S203). Values of the duty ratios F1 and F2 of the pulse width of the pulse voltage that drives the intake fan 200 and the exhaust fan 201 are appropriately set according to the models of the image forming apparatuses 100 with different productivities, and are stored in a memory 12 serving as a storage portion illustrated in FIG. 2.

In the present embodiment, a case of a model of the image forming apparatus 100 (second image forming apparatus) that can form an image on each of 35 recording materials 1 per minute (35 ppm) by cross feed, the recording material 1 being a A4-size plain paper (the basis weight is up to 105 $g/m^2$), is as follows. As illustrated in step S202, the duty ratio F1 of the pulse width of the pulse voltage that drives the intake fan 200 and the exhaust fan 201 serving as the second cooling fans is set to 100%, and the duty ratio F2 is set to 75%.

Further, cases of the models of the image forming apparatuses 100 with productivities that are other than 35 ppm are as follows. The model is a model of the image forming apparatus 100 (first image forming apparatus) that can form an image on each of 60 recording materials 1 per minute (60 ppm) by cross feed, the recording material 1 being a A4-size plain paper (the basis weight is up to 105 $g/m^2$). Further, the models are models of the image forming apparatuses 100 (first image forming apparatuses) that can form an image on each of 50 recoding materials 1 (50 ppm) and 40 recording materials 1 (40 ppm).

In that case, as illustrated in step S203, the duty ratio F1 of the pulse width of the pulse voltage that drives the intake fan 200 and the exhaust fan 201 serving as the first cooling fans is set to 100%, and the duty ratio F2 is set to 100%.

Accordingly, the numbers of revolutions of the intake fan 200 and the exhaust fan 201 serving as the second cooling fans driven and controlled with the duty ratio F2 of 75% are as follows. The second cooling fans are driven and controlled such that the numbers of revolutions become smaller than the numbers of revolutions of the intake fan 200 and the exhaust fan 201 serving as the first cooling fans driven and controlled at the duty ratio F2 of 100%.

In the present embodiment, the duty ratios F1 and F2 of the pulse width of the pulse voltage that drives the intake fan 200 and the exhaust fan 201 are set to the following relationship:

$$F1 \geq F2 \quad \text{[Formula 1]}$$

Next, the control operation proceeds to step S204. Steps S204 to S209, S212, and S213 illustrated in FIG. 5 are similar to steps S101 to S106, S108, and S109 described above with reference to FIG. 4, and thus overlapping description is omitted. In step S204, the inside temperature Ti is detected by the temperature sensor 203, and the outside temperature To is detected by the temperature sensor 202.

Next, the control operation proceeds to step S205. When the controller 11 determines that the inside temperature Ti is 24° C. or less, the control operation proceeds to step S213, and the intake fan 200 and the exhaust fan 201 are stopped.

Next, in step S206, when the inside temperature Ti is high temperature such as 31° C. or more, the control operation proceeds to step S210, and the cooling fans are rotated with the duty ratio F1 that is the duty ratio F of the pulse width of the pulse voltage that drives the intake fan 200 and the exhaust fan 201. Then, when the print job is terminated in step S214, the control operation proceeds to step S215, and the print job is terminated. When the print job is continued in step S214, the control operation returns to step S204.

In step S206, when the inside temperature Ti is lower than 31° C., the control operation proceeds to step S207. In step S207, when the inside temperature Ti is from 26° C. to 29° C., both inclusive, the control operation proceeds to step S208. Then, similarly to the above description, the operations of the intake fan 200 and the exhaust fan 201 are changed according to the correlation between the inside temperature Ti and the outside temperature To.

When the inside temperature Ti is from 24° C. to 26° C., both exclusive, or when the inside temperature Ti is from 29° C. to 31° C., both exclusive, the control operation proceeds to step S212, and immediately previous operations of the intake fan 200 and the exhaust fan 201 are maintained.

In step S207, when the inside temperature Ti is from 26° C. to 29° C., both inclusive, and in step S208, when the outside temperature To is higher than the inside temperature Ti, it is not necessary to take the hot outside air 9 into the main body of the image forming apparatus 100. Therefore, the control operation proceeds to step S213, and the intake fan 200 and the exhaust fan 201 are stopped.

In step S208, when the inside temperature Ti is the outside temperature To or more, and in step S209, when the inside temperature Ti is higher than the outside temperature To by 2° C. or more, the control operation proceeds to step S211. Then, the cooling fans are rotated at the duty ratio F2 that is the duty ratio F of the pulse width of the pulse voltage that drives the intake fan 200 and the exhaust fan 201.

Further, when the temperature difference $\Delta T$ (=Ti−To) between the inside temperature Ti and the outside temperature To is from 0° C. to 2° C., exclusive of 2° C., the control operation proceeds to step S212, and immediately previous operations of the intake fan 200 and the exhaust fan 201 are maintained.

In the present embodiment, the inside temperature Ti detected by the temperature sensor 203 and the outside temperature To detected by the temperature sensor 202 are detected on a steady basis during a print operation of the image forming apparatus 100. The operations of the intake fan 200 and the exhaust fan 201 are appropriately switched based on the detection result.

In the present embodiment, the inside temperature Ti (temperature information) is detected by the temperature sensor 203 serving as a plurality of temperature detecting portions. Further, the outside temperature To (temperature information) detected by the temperature sensor 202 is considered. The numbers of revolutions of the first and second cooling fans (the intake fan 200 and the exhaust fan 201) provided in the model of the image forming apparatuses 100 with different productivities (first and second image forming apparatuses 100) are based on the inside temperature Ti and the outside temperature To.

Note that the initial states of the intake fan 200 and the exhaust fan 201 are stop, and the operations of the intake fan 200 and the exhaust fan 201 are determined according to the flowchart of FIG. 5, in an adjusting operation when the power supply of the image forming apparatus 100 is turned ON.

Next, an operation example of the intake fan 200 and the exhaust fan 201 in the model of the image forming apparatus 100 with a productivity of 35 ppm (first image forming apparatus) will be described according to the flowchart illustrated in FIG. 5. The inside temperature Ti of the main body of the image forming apparatus 100 is changed during a print operation over time. This example is an operation example of the intake fan 200 and the exhaust fan 201 of that time.

For example, assume a case where the power supply of the image forming apparatus 100 is turned ON first thing in the morning and the recording material 1 is continuously printed in an environmental condition where the outside temperature To is 20° C. The initial inside temperature Ti when the power supply of the image forming apparatus 100 is turned ON first thing in the morning is 20° C. that is the same as the outside temperature To. In step S205 of FIG. 5, the inside temperature Ti of the image forming apparatus 100 is 24° C. or less, and thus the intake fan 200 and the exhaust fan 201 are stopped (step S213).

Next, the inside temperature Ti of the image forming apparatus 100 is raised by the print operation of the image forming apparatus 100. The immediately previous operations of the intake fan 200 and the exhaust fan 201 are maintained even if the inside temperature Ti exceeds 24° C. until the inside temperature Ti becomes 26° C. or more (step S212). Therefore, the intake fan 200 and the exhaust fan 201 remain stopped.

When the inside temperature Ti of the image forming apparatus 100 becomes 26° C. or more, the operations of the intake fan 200 and the exhaust fan 201 are determined according to the correlation between the inside temperature Ti and the outside temperature To (steps S208 and S209). When the outside temperature To is 20° C. and the inside temperature Ti is 26° C., the temperature difference ΔT (=Ti−To) of the both cooling fans is 6° C.

Therefore, in step S209, the temperature difference ΔT (=Ti−To) is 2° C. or more, and thus the control operation proceeds to step S211, and the cooling fans are started to operate at the duty ratio F2 of 75%, the duty ratio F2 being of the pulse width of the pulse voltage that drives the intake fan 200 and the exhaust fan 201 (step S202).

When the inside of the image forming apparatus 100 can be sufficiently cooled with the air quantity at the duty ratio F2 of 75%, the duty ratio F2 being of the pulse width of the pulse voltage that drives the intake fan 200 and the exhaust fan 201, the inside temperature Ti of the image forming apparatus 100 is gradually decreased.

At this time, when the inside temperature of the image forming apparatus 100 is 24° C. or more even if the inside temperature Ti is less than 26° C., the control operation proceeds to step S212, and the immediately previous operations of the intake fan 200 and the exhaust fan 201 are maintained. Therefore, the cooling fans are continuously operated at the duty ratio F2 of 75%, the duty ratio F2 being of the pulse width of the pulse voltage that drives the intake fan 200 and the exhaust fan 201, and the intake fan 200 and the exhaust fan 201 are stopped only after the inside temperature Ti of the image forming apparatus 100 becomes less than 24° C.

If the inside of the image forming apparatus 100 cannot be cooled with the air quantity at the duty ratio F2 of 75%, the duty ratio F2 being of the pulse width of the pulse voltage that drives the intake fan 200 and the exhaust fan 201, the inside temperature Ti of the image forming apparatus 100 is raised. At this time, the immediately previous operations of the intake fan 200 and the exhaust fan 201 are maintained in step S212 even when the inside temperature Ti of the image forming apparatus 100 exceeds 29° C. Therefore, the cooling fans are continuously operated at the duty ratio F2 of 75%, the duty ratio F2 being of the pulse width of the pulse voltage that drives the intake fan 200 and the exhaust fan 201.

In step S206 of FIG. 5, when the inside temperature Ti of the image forming apparatus 100 becomes 31° C. or more, the control operation proceeds to step S210. Then, the intake fan 200 and the exhaust fan 201 are rotated at the duty ratio F1 of 100% that is larger than the duty ratio F2 (70%) of the pulse width of the pulse voltage that drives the intake fan 200 and the exhaust fan 201 set in step S202, and coolability is enhanced.

Here, when the duty ratio F of the pulse width of the pulse voltage that drives the intake fan 200 and the exhaust fan 201 is changed, the numbers of revolutions of the intake fan 200 and the exhaust fan 201 are changed. For example, when the intake fan 200 and the exhaust fan 201 are rotated at the duty ratio F2 of 70%, the cooling fans are rotated in a state where the numbers of revolution are decelerated by 30% (100 to 70%) of the full speed, compared with the case where the intake fan 200 and the exhaust fan 201 are rotated at the duty ratio F1 of 100%.

As illustrated in steps S207 and S212 of FIG. 5, the immediately previous operations of the intake fan 200 and the exhaust fan 201 are maintained even when the inside temperature Ti of the image forming apparatus 100 is decreased to 29° C. Therefore, the intake fan 200 and the exhaust fan 201 are continuously rotated at the duty ratio F1 of 100%, the duty ratio F1 being of the pulse width of the pulse voltage that drives the intake fan 200 and the exhaust fan 201.

As illustrated in step S207 of FIG. 5, a case where the inside temperature Ti of the image forming apparatus 100 becomes 29° C. or less is as follows. As illustrated in steps S208 and S209, the operations of the intake fan 200 and the exhaust fan 201 are determined again from the correlation between the inside temperature Ti and the outside temperature To of the image forming apparatus 100.

As described above, the relationship between the duty ratios F1 and F2 of the pulse width of the pulse voltage that drives the intake fan 200 and the exhaust fan 201 is set to satisfy the condition indicated by Formula 1, according to the models of the image forming apparatuses 100 with different productivities.

Accordingly, at a normal time when the inside temperature Ti of the image forming apparatus 100 is not high temperature, the duty ratio F of the pulse width of the pulse voltage that drives the intake fan 200 and the exhaust fan 201 is suppressed to the duty ratio F2 (75%), and noise reduction can be achieved. Meanwhile, if the inside temperature Ti of the image forming apparatus 100 becomes high temperature, the control operation is as follows.

By rising the duty ratio F of the pulse width of the pulse voltage that drives the intake fan 200 and the exhaust fan 201 to F1 (100%), the coolability in the main body of the image forming apparatus 100 is enhanced and cooling can be performed.

Although not illustrated, a plurality of first and second cooling fans (intake fans 200 and exhaust fans 201) can be provided in the models of the image forming apparatuses 100 with different productivities (first and second image forming apparatuses). Then, cooling fans (an intake fan 200 and an exhaust fan 201) that are apart of the first and second cooling fans (intake fans 200 and exhaust fans 201) are as follows. The first and second cooling fans (the intake fan 200 and the exhaust fan 201) can be driven and controlled such that the numbers of revolutions become the same.

According to the present embodiment, in the models of the wide-range image forming apparatuses 100 that share a mechanical configuration with different productivities, a case of a model of the image forming apparatus 100 with a low productivity (second image forming apparatus) is as follows. The numbers of revolutions of the cooling fans (the intake fan 200 and the exhaust fan 201) arranged near an exterior material of the main body of the image forming apparatus 100 having a substantial influence on the operation noise of the image forming apparatus 100 are decreased.

Accordingly, the noise such as wind noise due to the cooling fans (the intake fan 200 and the exhaust fan 201) can be decreased, whereby the operation noise of the entire image forming apparatus 100 can be decreased. Accordingly, noise reduction of the model of the image forming apparatus 100 with a low productivity (second image forming apparatus) can be achieved.

Second Embodiment

Next, a configuration of a second embodiment of an image forming apparatus according to the present invention will be described using FIG. 6. Note that those similarly configured from those of the first embodiment are denoted with the same reference signs, or are given the same member names although denoted with different reference signs, and description thereof is omitted.

In the first embodiment, the duty ratio F2 of the pulse width of the pulse voltage that drives the intake fan 200 and the exhaust fan 201 has been changed only for the model of the image forming apparatus 100 with a productivity of 35 ppm. In the present embodiment, duty ratios F1 and F2 of a pulse width of a pulse voltage that drives an intake fan 200 and an exhaust fan 201 are changed for models of an image forming apparatus 100 with productivities of 35 ppm, 40 ppm, and 50 ppm.

For example, information about which model the image forming apparatus 100 corresponds to, among image forming apparatus 100 of a plurality of derivative models with different process speeds, is stored and registered in a memory (storage medium) provided in the image forming apparatus 100 in advance. A controller 11 can confirm models of the image forming apparatuses 100 with different productivities of 35 ppm, 40 ppm, and 50 ppm, from the model information stored in the memory.

Note that a duty ratio F1 of the pulse width of the pulse voltage that drives the intake fan 200 and the exhaust fan 201 is not necessarily set to 100% as long as an air quantity that can sufficiently cool an inside temperature Ti of the image forming apparatus 100 can be secured.

Figure 6:
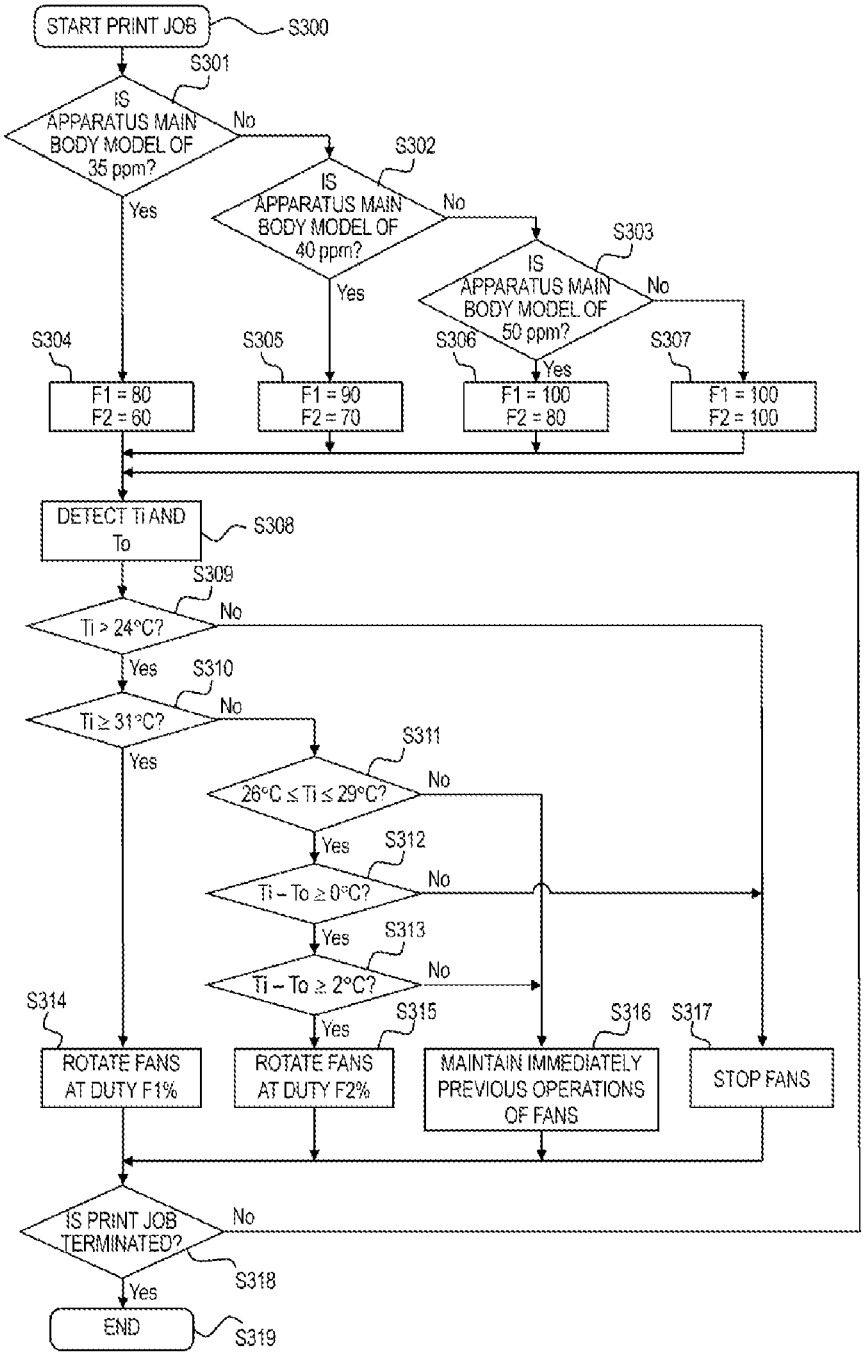
FIG. 6 is a flowchart illustrating drive control of cooling fans of a second embodiment of an image forming apparatus according to the present invention.

FIG. 6 is a flowchart illustrating drive control of the intake fan 200 and the exhaust fan 201 corresponding to the models of the image forming apparatuses 100 with productivities of 60 ppm, 50 ppm, 40 ppm, and 35 ppm. Note that steps S308 to S319 of FIG. 6 are approximately similar to steps S204 to S215 described with reference to FIG. 5, and thus overlapping description is omitted.

In step S301 of FIG. 6, a case of the model of the image forming apparatus 100 with a productivity of 35 ppm is as follows. As for the duty ratios F1 and F2 of the pulse width of the pulse voltage that drives the intake fan 200 and the exhaust fan 201, the duty ratio F1 is set to 80% and the duty ratio F2 is set to 60% (step S304).

In step S301, when the image forming apparatus 100 is not the model of the image forming apparatus 100 with a productivity of 35 ppm, the control operation proceeds to step S302. In step S302, when the image forming apparatus 100 is the model of the image forming apparatus 100 with a productivity of 40 ppm, the duty ratio F1 is set to 90% and the duty ratio F2 is set to 70% (step S305).

In step S302, when the image forming apparatus 100 is not the model of the image forming apparatus 100 with a productivity of 40 ppm, the control operation proceeds to step S303. In step S303, when the image forming apparatus 100 is the model of the image forming apparatus 100 with a productivity of 50 ppm, the duty ratio F1 is set to 100% and the duty ratio F2 is set to 80% (step S306).

In step S303, when the image forming apparatus 100 is the model of the image forming apparatus 100 with a productivity of 50 ppm, the controller 11 determines that the image forming apparatus 100 is the model of the image forming apparatus 100 with a productivity of 60 ppm, proceeds to step S307, and sets the duty ratios F1 and F2 to 100%.

As described above, the duty ratios F1 and F2 of the pulse width of the pulse voltage that drives the intake fan 200 and the exhaust fan 201 are appropriately set corresponding to the models of the image forming apparatuses 100 with productivities of 35 to 60 ppm. Accordingly, the duty ratios F of the pulse width of the pulse voltage that drives the intake fan 200 and the exhaust fan 201 are optimized. Accordingly, the rotation of the intake fan 200 and the exhaust fan 201 can be minimized and noise reduction of various models of the image forming apparatuses 100 with different productivities can be achieved.

In the present embodiment, the duty ratios F of the pulse width of the pulse voltage that drives the intake fan 200 and the exhaust fan 201 are controlled for each productivity according to the inside temperature Ti of the image forming apparatus 100, even among various models of the image forming apparatuses 100 with different productivities.

Accordingly, the noise reduction can be achieved while the configuration of the image forming apparatus 100 illustrated in FIGS. 1 to 3, the shapes of the intake duct 204 and the exhaust duct 205, the rated air quantities of the intake fan 200 and the exhaust fan 201, and the like are shared among various models of the image forming apparatuses 100 with different productivities. Other configurations are similarly configured from those in the first embodiment, and similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2015-169067, filed Aug. 28, 2015 which is hereby incorporated by reference herein in its entirety.

What is claimed is:

1. An image forming apparatus adaptable as a plurality of models including a first model and a second model, a maximum output number of recording medium per unit time of the second model in a case of forming an image on a recording medium of a predetermined size being less than a maximum output number of recording medium per unit time of the first model in a case of forming an image on a recording medium of the predetermined size, the image forming apparatus operating as one of the plurality of models and comprising:

an image forming portion configured to form an image on a recording medium including the recording medium of the predetermined size and having a driving motor included in a driving system of the image forming apparatus, a rotation speed of the driving motor for the second model in a case of forming an image on the recording medium with the maximum output number of the recording medium of the predetermined size being slower than a rotation speed of the driving motor for the first model in a case of forming an image on the recording medium with the maximum output number of the recording medium of the predetermined size;

a temperature detecting portion configured to detect temperature;

a fan configured to cool the image forming portion; and a controller configured to identify one of the plurality of models that corresponds to the image forming apparatus, control the fan at a first rotation speed in a case that the image forming apparatus is identified as the first model and a detection result detected by the temperature detecting portion is equal to or lower than a predetermined value, and control the fan at a second rotation speed slower than the first rotation speed in a case that the image forming apparatus is identified as the second model and a detection result detected by the temperature detecting portion is equal to or lower than the predetermined value.

2. The image forming apparatus according to claim 1, wherein the controller controls the fan at the first rotation speed, regardless of model of the image forming apparatus, in a case that the detection result by the temperature detecting portion is higher than the predetermined value.

3. The image forming apparatus according to claim 1, wherein the predetermined value of the temperature is a first value and the controller controls stopping of the fan in a case that the temperature detected by the temperature detecting portion is a second value lower than the first value.

4. The image forming apparatus according to claim 1, wherein the temperature detecting portion detects the temperature inside of the image forming apparatus and the image forming apparatus comprises another temperature detecting portion which is different from the temperature detecting portion and configured to detect the temperature outside of the image forming apparatus, and wherein the controller controls the fan at the second speed, in a case that the image forming apparatus is identified as the second model and the detection result by the temperature detecting portion is lower than the predetermined value and a difference between the detection result by the temperature detecting portion and a detection result by the other temperature detecting portion is greater than a predetermined difference.

5. The image forming apparatus according to claim 1, wherein the fan is an intake fan configured to intake air into inside of the image forming apparatus.

6. The image forming apparatus according to claim 1, wherein the fan is an exhaust fan configured to exhaust air from inside of the image forming apparatus.

7. The image forming apparatus according to claim 1, wherein the predetermined size is A4 size.

8. The image forming apparatus according to claim 1, wherein the plurality of models includes a third model, a maximum output number of recording medium per unit time of the third model in a case of forming an image on a recording medium of the predetermined size being less than the maximum output number of recording medium per unit time of the first model and greater than the maximum output number of recording medium per unit time of the second model, and the controller controls the fan at a third speed which is slower than the first speed and faster than the second speed in a case that the image forming apparatus is the third model and the detection result by the temperature detecting portion is lower than the predetermined value.

9. An image forming apparatus adaptable as a plurality of models including a first model and a second model, a maximum output number of recording medium per unit time of the second model in a case of forming an image on a recording medium of a predetermined size being less than a maximum output number of recording medium per unit time of the first model in a case of forming an image on a recording medium of the predetermined size, the image forming apparatus operating as one of the plurality of models and comprising:

an image forming portion configured to form an image on a recording medium including the recording medium of the predetermined size and having a driving motor included in a driving system of the image forming apparatus, a rotation speed of the driving motor for the second model in a case of forming an image on the recording medium with the maximum output number of the recording medium of the predetermined size being slower than a rotation speed of the driving motor for the first model in the case of forming an image on the recording medium with the maximum output number of the recording medium of the predetermined size;

a fan configured to cool the image forming portion;

a temperature detecting portion configured to detect temperature;

a storage portion configured to store model data indicating one of the plurality of models that corresponds to the image forming apparatus and control data indicating rotation speeds of the fan, the control data being related to the plurality of models, respectively, and including first data and second data adoptable in a case that a detection result by the temperature detecting portion satisfies a predetermined condition, the first data indicating the rotation speed of the fan for the first model and the second data indicating the rotation speed of the fan for the second model, the rotation speed in the second data being slower than the rotation speed in the first data; and a controller configured to control the rotation speed of the driving motor according to the model data and to control the rotation speed of the fan according to the model data and the control data corresponding to the model data.

10. The image forming apparatus according to claim 9, wherein the plurality of models includes a third model, a maximum output number of recording medium per unit time of the third model in a case of forming an image on a recording medium of the predetermined size being less than the maximum output number of recording medium per unit time of the first model and greater than the maximum output number of recording medium per unit time of the second model, the control data has third data indicating the rotation speed of the fan for the third model and being adoptable in a case that a detection result by the temperature detecting portion satisfies the predetermined condition, the rotation speed in the third data being slower than the rotation speed in the first data and faster than the rotation speed in the second data, and the controller controls the fan according to the third data in a case that the image forming apparatus is of the third model and the detection result by the temperature detecting portion satisfies the predetermined condition.

11. The image forming apparatus according to claim 9, wherein the predetermined condition is that the detection result by the temperature detecting portion is lower than a predetermined highest value and higher than a predetermined lowest value, the control data includes common data indicating a same rotation speed of the fan both for the image forming apparatus of the first model and the second model in a case the detection result by the temperature detecting portion is higher than the predetermined highest value, and the controller controls the fan according to the common data in a case the detection result by the temperature detecting portion does not satisfy the predetermined condition and is higher than the highest predetermined value.

12. The image forming apparatus according to claim 11, wherein the control data includes additional data for stopping rotation of the fan in a case the detection result by the temperature detecting portion is lower than the predetermined lowest value, and the controller controls the fan stopping according to the additional data in a case the detection result by the temperature detecting portion does not satisfy the predetermined condition and is lower than the lowest predetermined value.

13. The image forming apparatus according to claim 9, wherein the temperature detecting portion detects the temperature inside of the image forming apparatus, the image forming apparatus comprises another temperature detecting portion which is different from the temperature detecting portion and is configured to detect the temperature outside of the image forming apparatus, and the controller controls the fan according to the first data in a case the image forming apparatus is the first model and according to the second data in a case that image forming apparatus is the second model in a state that the detection result by the temperature detecting portion satisfies the predetermined condition and a difference between the detection result by the temperature detecting portion and a detection result by the other temperature detecting portion is greater than a predetermined difference.

14. The image forming apparatus according to claim 9, wherein the fan is an intake fan configured to intake air into inside of the image forming apparatus.

15. The image forming apparatus according to claim 9, wherein the fan is an exhaust fan configured to exhaust air from inside of the image forming apparatus.

16. The image forming apparatus according to claim 9, wherein the predetermined size is A4 size.

17. An image forming apparatus adaptable as a plurality of models including a first model and a second model, a maximum output number of recording medium per unit time of the second model in a case of forming an image on a recording medium of a predetermined size being less than a maximum output number of recording medium per unit time of the first model in a case of forming an image on a recording medium of the predetermined size, the image forming apparatus operating as one of the plurality of models and comprising:

an image forming portion configured to form an image on a recording medium including the recording medium of the predetermined size and having a driving motor included in a driving system of the image forming apparatus, a rotation speed of the driving motor for the second model in a case of forming an image on the recording medium with the maximum output number of the recording medium of the predetermined size being slower than a rotation speed of the driving motor for the first model in a case of forming an image on the recording medium with the maximum output number of the recording medium of the predetermined size;

a fan configured to cool inside of the image forming portion; and a storage portion configured to store model data indicating one of the plurality of models that corresponds to the image forming apparatus and control data indicating rotation speeds of the fan, the control data including first data indicating the rotation speed of the fan for the first model and second data indicating the rotation speed of the fan for the second model, the rotation speed in the second data being slower than the rotation speed in the first data; and a controller configured to control the rotation speed of the driving motor according to the model data and to control the rotation speed of the fan according to the model data and the control data corresponding to the model data.

18. The image forming apparatus according to claim 17, wherein the fan is an intake fan configured to intake air into inside of the image forming apparatus.

19. The image forming apparatus according to claim 17, wherein the fan is an exhaust fan configured to exhaust air from inside of the image forming apparatus.

20. The image forming apparatus according to claim 17, wherein the predetermined size is A4 size.

21. A non-transitory storage medium storing a computer program being run by a controller of an image forming apparatus operating as one of a plurality of models, the image forming apparatus being adaptable as the plurality of models including a first model and a second model, a maximum output number of recording medium per unit time of the second model in a case of forming an image on a recording medium of a predetermined size being less than a maximum output number of recording medium per unit time of the first model in a case of forming an image on a recording medium of the predetermined size, the image forming apparatus comprising:

an image forming portion configured to form an image on a recording medium including the recording medium of the predetermined size;

a driving motor included in a driving system of the image forming apparatus, a rotation speed of the driving motor for the second model in a case of forming an image on the recording medium with the maximum output number of the recording medium of the predetermined size being slower than a rotation speed of the driving motor for the first model in a case of forming an image on the recording medium with the maximum output number of the recording medium of the predetermined size;

a fan configured to cool the image forming portion; and a memory portion configured to store model data indicating one of the plurality of models that corresponds to the image forming apparatus and controlling data indicating a rotation speed of the fan, the controlling data including first data as a rotation speed for the first model and second data as a rotation speed for the second model, wherein the computer program stored in the non-transitory storage medium comprises:

a step to identify one of the plurality of models based on the model data at a start of an operation of the image forming apparatus;

a step to control the rotation speed of the driving motor based on the model data; and a step to control the rotation speed of the fan based on the model data and the controlling data.

22. A non-transitory storage medium storing a computer program being run by a controller of an image forming apparatus operating as one of a plurality of models, the image forming apparatus being adaptable as the plurality of models including a first model and a second model, a maximum output number of recording medium per unit time of the second model in a case of forming an image on a recording medium of a predetermined size being less than a maximum output number of recording medium per unit time of the first model in a case of forming an image on a recording medium of the predetermined size, the image forming apparatus comprising:

an image forming portion configured to form an image on a recording medium including the recording medium of the predetermined size;

a driving motor of which a rotation speed for the second model in a case of forming an image on the recording medium with the maximum output number of the recording medium of the predetermined size is slower than a rotation speed of the driving motor for the first model in a case of forming an image on the recording medium with the maximum output number of the recording medium of the predetermined size;

a fan configured to cool the image forming portion;

a temperature detecting portion configured to detect a temperature; and a memory portion configured to store model data indicating one of the plurality of models that corresponds to the image forming apparatus and controlling data indicating a rotation speed of the fan, the controlling data including first data and second data adoptable in a case that a detection result by the temperature detecting portion satisfies a predetermined condition, the first data indicating a rotation speed for the first model and the second data indicating a rotation speed for the second model, the rotation speed in the second data being slower than the rotation speed in the first data, wherein the computer program stored in the non-transitory storage medium comprises:

a step to identify one of the plurality of models based on the model data at a start of an operation of the image forming apparatus;

a step to control the rotation speed of the driving motor based on the model data; and a step to control the rotation speed of the fan based on the model data and the controlling data.

* * * * *